US006186241B1

(12) United States Patent
Murr

(10) Patent No.: US 6,186,241 B1
(45) Date of Patent: Feb. 13, 2001

(54) METHOD AND APPARATUS FOR AUTOMATIC EXTINGUISHMENT OF FIRES IN DEEP FRYERS

(76) Inventor: Michael J. Murr, 1001 NW. 45$^{th}$ Ave., Coconut Creek, FL (US) 33066

( * ) Notice: Under 35 U.S.C. 154(b), the term of this patent shall be extended for 0 days.

(21) Appl. No.: 09/500,261

(22) Filed: Feb. 8, 2000

(51) Int. Cl.$^{7}$ ..... A62C 37/10; A62C 13/62
(52) U.S. Cl. ..... 169/60; 169/65
(58) Field of Search ..... 169/56, 60, 65

(56) References Cited

U.S. PATENT DOCUMENTS

| | | | | |
|---|---|---|---|---|
| 4,217,482 | | 8/1980 | Wadia | 219/494 |
| 4,520,717 | * | 6/1985 | Bohrer, Jr. et al. | 169/65 |
| 4,524,835 | | 6/1985 | Mingrone | 169/65 |
| 4,580,638 | | 4/1986 | Jones et al. | 169/49 |
| 4,830,116 | | 5/1989 | Walden et al. | 169/65 |
| 5,099,976 | * | 3/1992 | Jamison | 169/54 |
| 5,129,386 | | 7/1992 | Meister | 126/299 R |
| 5,490,567 | | 2/1996 | Speer | 169/50 |
| 5,697,450 | | 12/1997 | Stehling et al. | 169/65 |
| 5,706,717 | * | 1/1998 | Barner | 99/330 |
| 5,820,776 | | 10/1998 | Hansen et al. | 252/2 |
| 5,839,355 | | 11/1998 | Faulkner | 99/330 |
| 5,871,057 | | 2/1999 | Stehling et al. | 169/65 |
| 5,908,551 | | 6/1999 | Onken | 210/184 |
| 5,910,206 | | 6/1999 | Mcnamara | 99/330 |
| 5,927,142 | * | 7/1999 | Mercer | 73/296 |

* cited by examiner

*Primary Examiner*—Lesley D. Morris
*Assistant Examiner*—Davis Hwu
(74) *Attorney, Agent, or Firm*—John C. Smith

(57) ABSTRACT

A deep fryer with an automatic fire extinguishing system. The oil storage tank is attached to the oil reservoir of the deep fat fryer. A drain valve controls drainage of oil in the deep fryer oil reservoir to the oil storage tank. A fire sensing device is attached to, and controls, the drain valve and opens the drain valve when a fire is detected. The oil storage tank smothers any fire from oil inside it by preventing sufficient air flow to keep the fire burning. Any remaining oil which has not drained the into the oil storage tank quickly burns out and the fire is extinguished. A drain valve in the oil storage tank allows the oil to be recovered and placed back into the oil reservoir of the deep fat fryer for reuse. An air valve in the oil storage tank allows air to evacuate the tank as it is being filled with oil.

20 Claims, 7 Drawing Sheets

Prior Art

Prior Art

METHOD AND APPARATUS FOR AUTOMATIC EXTINGUISHMENT OF FIRES IN DEEP FRYERS

BACKGROUND ART

One of the most common cooking devices used is the deep fryer. Deep fryers are commercially used by restaurants, institutional kitchens, and fast food establishments for cooking a variety of food products, such as french fries, fish, chicken, seafood, etc. Deep fryers are also available for use in residential environments.

A deep fryer cooks food by totally immersing it within a vat or tank that is filled with heated oil or shortening (for ease of discussion, the heated oil, shortening, grease, or other heating agents used by the deep fryer will hereinafter collectively be referred to as "oil"). The oil may be heated by any suitable manner. For example, it can be heated by using a flow of heated gas that is forced or drawn through a heat exchanger having flow passages that are located within or external to the cooking vat. A gas burner is provided to heat the gas circulating within the heat exchanger. Likewise, it is also possible to use a deep fryer that is electrically heated.

While deep fryers provide the ability to cook a variety of foods in a convenient manner, they also create some unique safety hazards. In particular, deep fryer oil fires are not uncommon and can cause substantial damage to a restaurant, including destruction of the entire building the restaurant is in. Of course, and any fire situation there is substantial risk to individuals near the fire.

One reason why deep fryer fires are so dangerous is that there is a substantial amount of oil in the reservoir of the deep fryer, and the oil acts as a large fuel supply to continue the fire and potentially place restaurant employees and emergency personnel at risk. It would be desirable to have a method of preventing the reservoir of oil in a deep fryer from becoming a fuel supply for a fire.

In the fire extinguishing art, fires are divided into four general classes; namely, Class A, Class B, Class C and Class D.

Class A, C and D fires are not related to the type of fire found in the deep fryer. Class A fires involve combustible material such as paper, wood, etc. They are extinguished by quenching and cooling with large quantities of water or solutions containing a large percentage of water. Class C fires involve electrical equipment. This type of fire is extinguished with dry fire extinguishing agents. Class D fires involve combustible metals and are typically extinguished with special dry powders.

The instant invention is directed to class B fires which occur in deep fryers. Class B fires involve shortening, oils, greases, flammable liquids, etc. In this type of fire, water is typically not used because when the water contacts the hot oil, it may cause splattering without extinguishing the flames. In addition, when the hot oil splatters, hot burning oil may cause the fire to spread and may also cause serious injury to anyone standing nearby. Class B fires are difficult to extinguish because of the low auto-ignition points of deep fryer oil (which can be any number of shortening, oils and greases). As noted above, in addition to the low ignition temperature, the oil reservoir in the deep fryer contains a large amount of oil which acts as a fuel supply to feed the fire for a substantial period of time. The longer the fire is active, the greater the risk that the fire will spread. As a result, because of the large quantity of available oil typically found in a deep fryer, it is extremely important to extinguish the fire as rapidly, because the reservoir of oil can provide sufficient fuel supply for the fire to allow the fire to spread. In addition, even if the fire is extinguished quickly, there is a secondary fire hazard which can occur due to "reflash" (i.e. re-ignition of the fire because the oil remains above the ignition temperature after the flames have been extinguished) which can occur at a lower temperatures.

Attempts to extinguish class B fires have resulted in the development of many different fire extinguishing compositions and fire extinguishing systems which are designed to extinguish the oil fire while the oil remains in the deep fryer. While these extinguishing systems may be effective in putting out the fire, they can take a substantial amount of time which may result in substantial property damage or injury to individuals.

In addition, re-flash or auto-ignition of the hot oil in a class B fire remains a serious problem. Further, when such fires involve large commercial establishments, such as restaurants, cafeterias, mess halls, etc., the potential damage caused by such fires may be substantial. The prior art systems typically are directed to extinguishing the fire and are not directed to eliminating the fire's fuel supply which is represented by the oil reservoir of the deep fryer. It would be desirable to have an improved method of extinguishing a class B fire (the type which occurs in a deep fryer) which eliminates the fuel supply of the fire, and which simultaneously eliminates the splattering of the oil in the deep fryer reservoir and the risk of reflash.

In addition to the attempts to control and extinguish class B fires through the use of chemicals, prior art attempts to extinguish fires such as those found in the fryers have included mechanical devices. In particular, attempts have been made to smother deep fryer fires by covering the deep fryer with a fireproof blanket. This type of blanket may be deployed through the use of automatic machines that are controlled by fire sensors, or they may be manually thrown over the deep fryer. The use of manually deployed blankets can be hazardous since the individuals deploying the blanket must come close to the fire, exposing themselves to danger.

While addressing the basic desirability of extinguishing class B fires, the prior art has failed to provide a system which rapidly extinguishes fires in deep fryers by eliminating the fuel supply for the fire, which in turn eliminates the dangers caused by splattering that may occur while the fire is being extinguished, and which further eliminates the potential for reflash after the initial fire has been extinguished.

SUMMARY OF THE INVENTION

The present invention solves the foregoing problems by providing an automatic dumping system which removes the oil to a sealed tank where the fire is smothered. A sensing system detects the presence of fire and automatically opens a drain valve which drains the oil from a deep fryer reservoir into a sealed oil storage tank. The oil storage tank smothers any fire from oil inside it by preventing sufficient air flow to keep the fire burning. Any remaining oil which has not drained into the oil storage tank quickly burns out and the fire is extinguished. A drain valve in the oil storage tank allows the oil to be recovered and placed back into the oil reservoir of the deep fat fryer for reuse. An air valve in the oil storage tank allows air to evacuate the tank as it is being filled with oil.

DESCRIPTION OF THE PREFERRED EMBODIMENT

Figure 1:
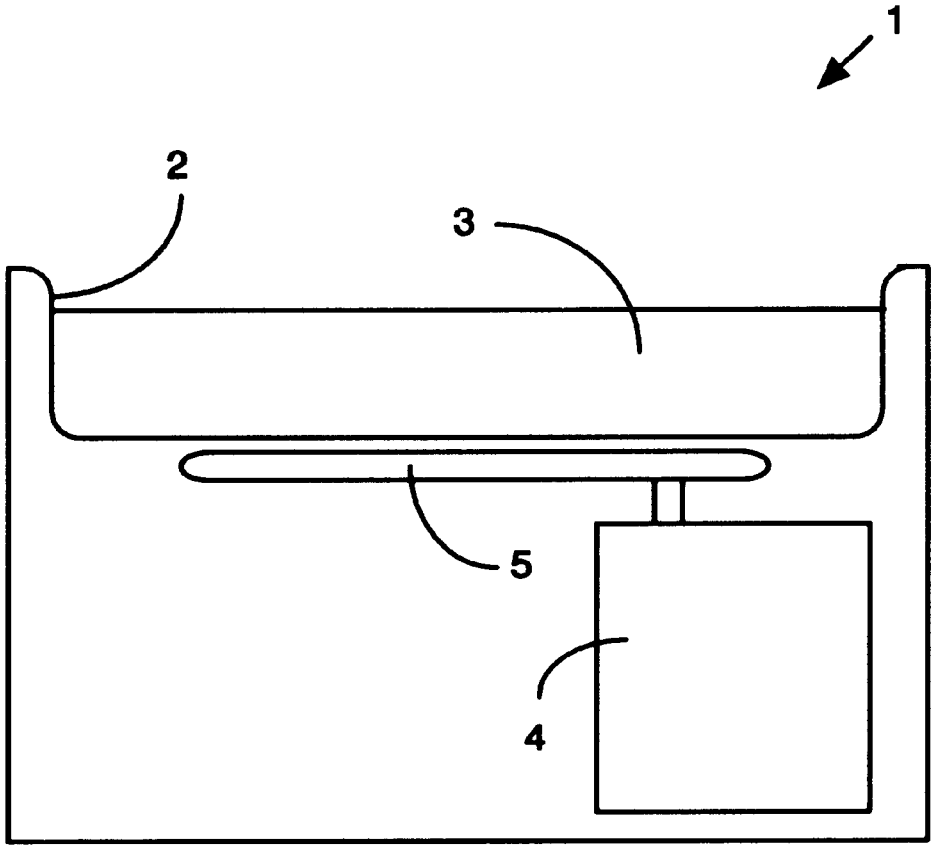
FIG. 1 illustrates a conventional prior art deep fryer.

Prior to a discussion of the figures, a general overview of the features and advantages of the invention will be presented. As mentioned above, the prior art attempts at extinguishing fires in devices such as deep fryers has focused on methods of extinguishing the fire by spraying chemicals on the fire, or attempting to smother the fire via mechanical blanket assemblies. While these approaches work, they take a long time to extinguish the fire, they do not adequately address the problem of reflash since the hot oil remains in the reservoir of the deep fryer, and it may re-ignite as soon as blanket is removed, or the application of the chemicals is stopped.

In the preferred embodiment, the system performs several functions. First, when there is a fire, fuel oil is automatically and drained from the deep fryer reservoir into an oil storage tank. At the same time, the power source that heats the oil reservoir of the deep fryer is turned off. At this point, the temperature sensed by the fire detector should start to decline. Next, an alarm will be activated. The alarm can be an audible alarm, a visual alarm, or both. In addition, the alarm can be set up to automatically notify emergency personnel such as the fire department.

The invention extinguishes the fire by eliminating the fuel supply. By removing the oil, the fuel for the fire is eliminated and the fire extinguishes by itself. In addition, the invention simultaneously eliminates the related problems of reflash and splattering. By removing the oil, there is nothing left to splatter. As a result, nearby structures or individuals will not be at risk of being splattered by hot flaming oil. The elimination of the splattering risk also eliminates the risk of secondary fires set by splattering oil.

The other related problem, reflash, is also eliminated because the oil is removed from the reservoir the deep fryer to a sealed unit which smothers the fire and prevents reignition.

The advantages of the invention are achieved by an oil storage tank which is connected to the reservoir in the deep fryer by a drain conduit. A drain control valve controls movement of oil through the drain conduit. The drain control valve is in turn controlled by a fire sensing device. In normal operating situations, the drain control valve is closed, the oil remains in the oil reservoir of the deep fryer, and the oil storage tank remains empty. If the fire is detected, the fire sensing device activates the drain control valve which then opens. Once the drain control valve opens, the oil in the oil reservoir of the deep fryer drains through the drain conduit to the oil storage tank.

When the oil is removed from the oil reservoir of the deep fryer and stored in the oil storage tank, the fuel for the fire is effectively removed. The small amount of oil that may remain will quickly burn itself out, and with the fuel removed, the fire will extinguish itself. By sizing the drain conduit for a given size deep fryer reservoir, the deep fryer can be emptied in seconds. Due to the speed and efficiency provided by the invention, deep fryer oil fires can be extinguished before any significant damage is done. Further, the risk of splattering and reflash is eliminated.

When the oil is drained into the oil storage tank, it is smothered because the oil storage tank is designed such that there is insufficient oxygen to sustain the fire. The oil storage tank is designed as a sealed unit which also eliminates any splattering risk. The oil storage tank is not hot, as the oil reservoir is, and it allows the oil to rapidly cool below the reflash temperature. Further, even if the oil was sufficiently hot to reflash, the lack of oxygen in the oil storage tank would prevent re-ignition.

The oil storage tank is preferably designed such that it is below the deep fryer reservoir in order to allow a gravity controlled drainage of the oil to the oil storage tank. This allows the drainage mechanism to be designed in the simplest manner. Of course, those skilled in the art will recognize that the oil storage tank does not have to be placed below the deep fryer reservoir. In that the case, the drainage mechanism can include a pump to pull the oil from the deep fryer reservoir and pump it to an oil storage tank which may be placed in any convenient location.

The preferred embodiment also includes an air valve at the top of the oil storage tank which is designed to allow air to escape. By having the air valve, the oil can drain into the oil storage tank without being impeded by air pressure in the oil storage tank. The air valve can be a custom designed air valve, or can be fabricated from commercially available air valves.

Once the fire is extinguished, the oil in the oil storage tank is suitable for reuse. To allow the oil to be transferred back to the reservoir of the deep fryer, the oil storage tank has a drain valve that allows the oil to be drained out. In a preferred embodiment, the oil storage tank is detached from the deep fryer assembly and lifted to allow manual draining of the oil back into the deep fryer reservoir. Of course, is also possible to pump the oil from the oil storage tank to the deep fryer reservoir.

By removing the fuel needed to keep the fire burning, the fire is quickly and easily extinguished. In addition, since the oil is removed from the deep fryer reservoir, there is no longer any possibility of splattering. This eliminates possibility that the fire will spread due to splattering, or that individuals will be injured due to the splattering. Further, the elimination of the oil conduit by dumping it into the oil storage tank also eliminates the risk of reflash since there is nothing left to re-ignite. As a result of the invention, the drawbacks of the prior art have been overcome by rapidly extinguishing the fire, by eliminating the risk of splattering, and by eliminating the possibility of reflash in the oil reservoir by eliminating the fuel and by eliminating the possibility of ignition or reflash in the oil storage tank by limiting the amount of available oxygen.

Referring now to FIG. 1, this figure shows a prior art deep fryer 1. In this figure, the deep fryer 1 includes an oil reservoir 2 which holds a supply of oil 3. Also shown in this figure is a heating unit 4 which supplies heat to a heating element 5 which transfers heat to the reservoir 2. The heating unit 4 and the heating element 5 can be gas fired or electrical. Commercially available heating units 4 and heating elements 5 are well known in the art.

A disadvantage associated with the prior art deep fryers 1 is that they hold a substantial amount of oil 3. This oil 3 represents a substantial reserve of fuel which will keep a fire in a deep fryer burning for long period of time. While the fire burning, substantial smoke damage can occur, substantial splattering can occur, and even when the fire is extinguished, a substantial risk of reflash remains. In addition, the longer the fire burns, the greater the temperature rises and the more difficult it becomes for emergency personnel to put out the fire.

Figure 2:
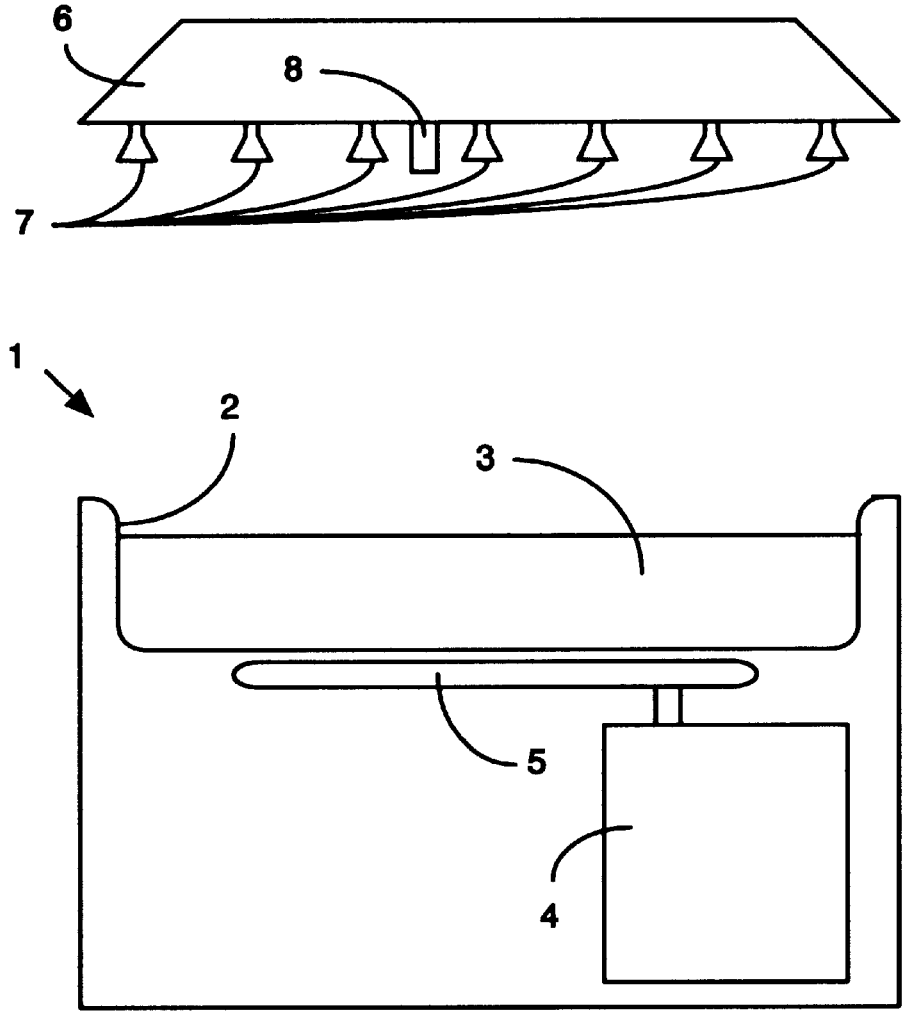
FIG. 2 illustrates a conventional prior art fire extinguishing system.

In FIG. 2, an example of a conventional prior art fire extinguishing system is shown. In this system, a stove hood 6 is mounted above the deep fryer 1. A series of fired extinguisher nozzles 7 are mounted in the stove hood 6 above the deep fryer 1. Additionally, a fire sensing device 8 is mounted in the stove hood 6. When the fire sensing device 8 detects a fire, it activates the fire extinguisher nozzles 7 which spray chemicals on the deep fryer 1 to extinguish the fire.

The disadvantage to this method of extinguishing fires is that while the fire extinguishing system above the deep fryer 1 is attempting to put out the fire, the supply of fuel for the fire (the oil 3) is helping to maintain the fire from below.

Figure 3:
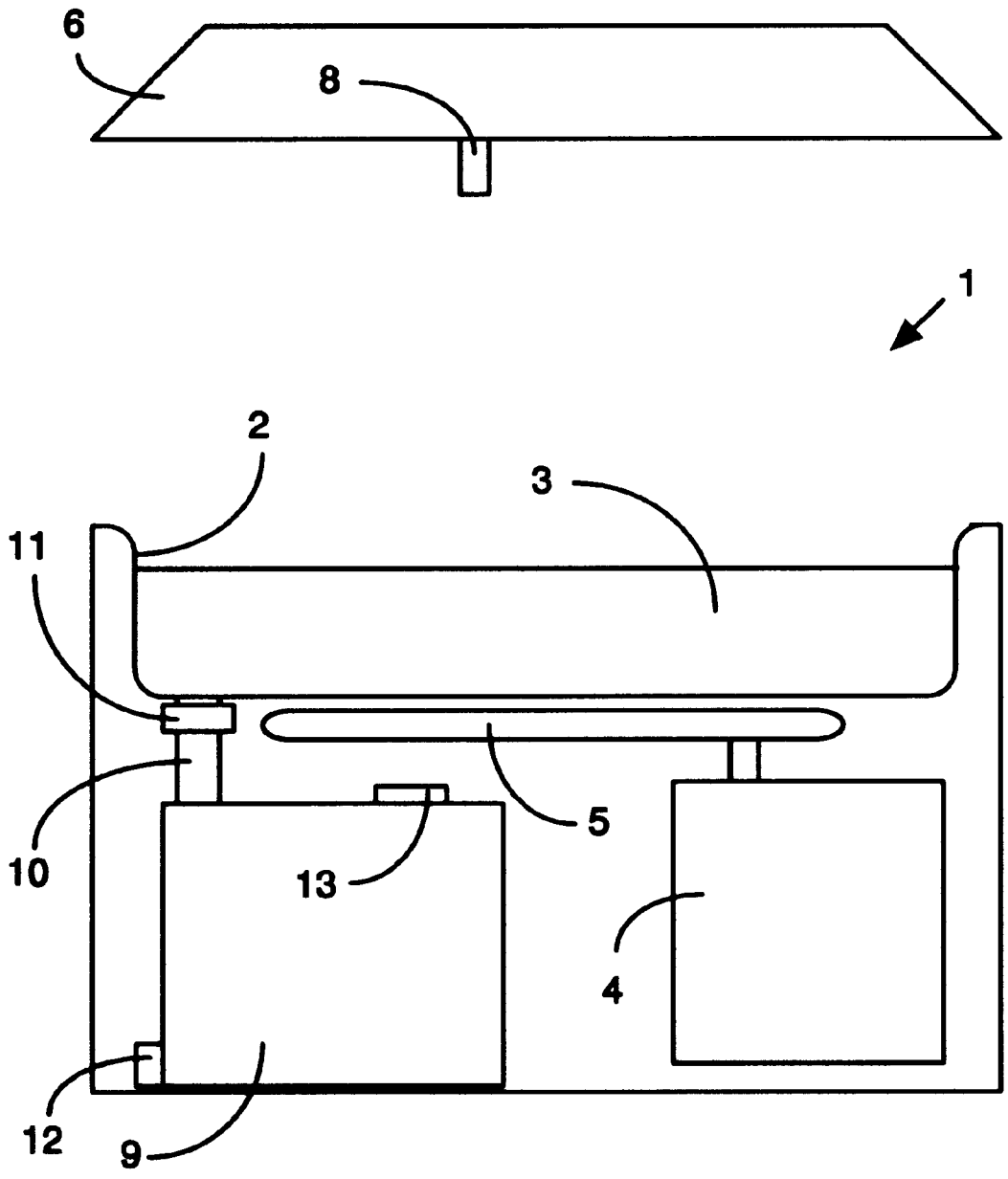
FIG. 3 illustrates a preferred embodiment of the invention in which an oil storage tank is connected to a deep fryer oil reservoir via the valve controlled drain conduit which is activated by a fire detector.

FIG. 3 illustrates a preferred embodiment of the invention during normal operation. In this embodiment, the deep fryer 1 has several additional elements which are designed to remove the oil 3 from the reservoir 2 when a fire is detected by the fire detector 8. For ease of illustration, the fire detector 8 is shown mounted above the oil reservoir, but in practice, it may be placed in any suitable location. An oil storage tank 9 is disposed beneath the reservoir 2. The capacity of the oil storage tank 9 is sufficient to hold the oil 3 currently in the reservoir 2. The oil storage tank 9 is connected to the reservoir 2 via a drain conduit 10. The drain conduit 10 is opened and closed under control of a drain conduit control valve 11.

In normal operation, the drain conduit control valve 11 is closed, and the oil 3 remains in the reservoir 2. In the event a fire is detected by fire detector 8, the fire detector 8 activates the drain conduit control valve 11 which then opens. When the drain conduit control valve 11 opens, the oil 3 in the reservoir 3 drains through drain conduit 10 into oil storage tank 9. When this happens, two things occur. First, the fuel which supports the fire in the deep fryer 1 is removed. This starves the fire which then self extinguishes. Second, when the fuel drains into the oil storage tank 9, even if the fuel is on fire when it enters the oil storage tank 9, it is quickly smothered due to lack of oxygen in the sealed oil storage tank 9. This not only extinguishes the fire, but also preserves the oil 3 so that it may be reused later.

Also shown in this figure is air valve 13 which allows the air in the oil storage tank 9 to bleed out while the oil 3 is draining into the oil storage tank 9. This allows the oil 3 to drain more rapidly because there will be no back pressure caused by the inability of air to escape the oil storage tank 9. Pressure release valves are well known in the art. It has been found that a simple screw on pressure release valve, such as those used as gas tank caps on automobiles are suitable for use as air valves 13.

Also shown in this figure is drain valve 12. Drain valve 12 allows the oil storage tank 9 to be emptied in the event the drain conduit control valve 11 is opened as the result of a fire. After the fire is put out and the deep fryer 1 is ready to be used again, the oil storage tank 9 can be drained to allow the oil 3 to be reused.

Figure 4:
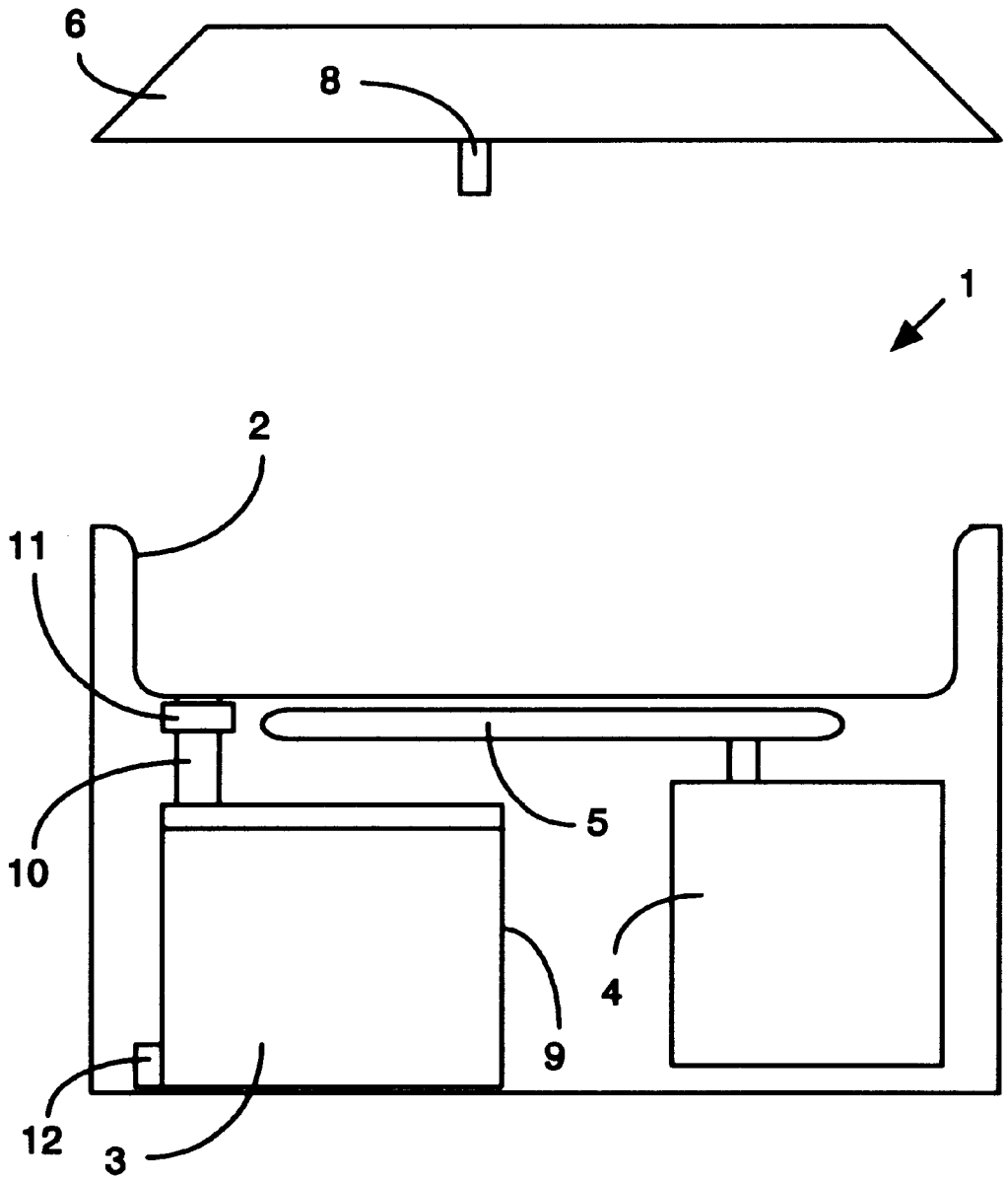
FIG. 4 illustrates the preferred embodiment of FIG. 3 after the oil has been drained into the oil storage tank.

In FIG. 4, the embodiment of FIG. 3, above, is shown. This figure illustrates the deep fryer 1 after the drain conduit control valve 11 has opened and the oil 3 has drain into the oil storage tank 9. As can be seen, the oil 3 substantially fills the oil storage tank 9 which leaves very little air to support a fire. Further, even if the oil 3 is on fire when it enters the oil storage tank 9, the smoke will quickly fill the air space inside oil storage tank 9 and extinguish the fire by depriving it of oxygen.

Figure 5:
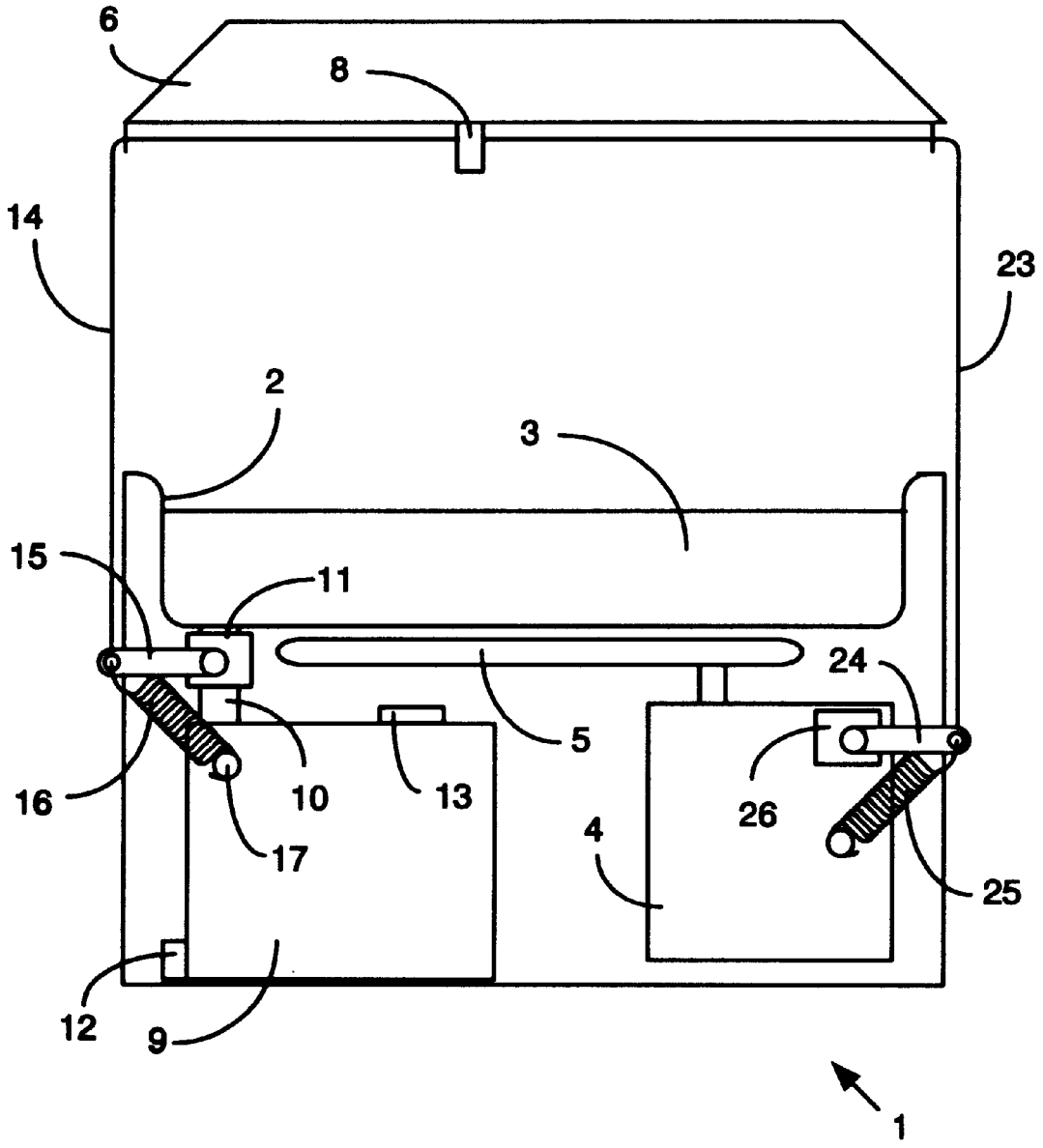
FIG. 5 shows an alternative preferred embodiment in which the drain conduit control valve is activated by a spring loaded mechanical fuse link. This figure shows the deep fryer in operational mode with the drain conduit control valve in the closed position.

FIG. 5 illustrates an alternative preferred embodiment in which a mechanical fuse link 14 holds a spring loaded drain conduit control valve 11 in the closed position. During normal operation, the fuse link 14 is routed from the hood 6 to a lever 15. The lever 15 controls position of the drain conduit control valve 11. A spring 16 is secured at one end to a fixed post 17, and secured at the other end to the lever 15. In this operational configuration, the fuse link 14 holds a spring 16 under tension and holds the lever 15 in the closed position.

Those skilled in the art will recognize that while the fire detector 8 and the fuse link 14 are shown as separate units, the fuse link 14 can be designed such that it replaces the fire detector by melting at a predetermined temperature. In the preferred embodiment, the fuse link 14 will melt at the appropriate temperature. It has been found that commercially available fishing leader line can be used as a suitable fuse link material. There's also possible to put in an identical fuse link 23 which will be used to turn off heating unit 4 at the same time. Mechanical fuse link 23 is attached to lever 24 which is controlled by spring 25 in the same manner as was done for lever 15. Switch 26 control by lever 24 and deactivates heating unit 4 when fuse link 23 melts. Likewise, those skilled in the art will recognize that the lever 15 could also be gang switched with the controls for heating unit 4. The advantage of either of these approaches is that the heating unit 4 will be automatically shut down when the oil 3 is drained to the storage tank 9 to avoid heating an empty oil reservoir 2.

Figure 6:
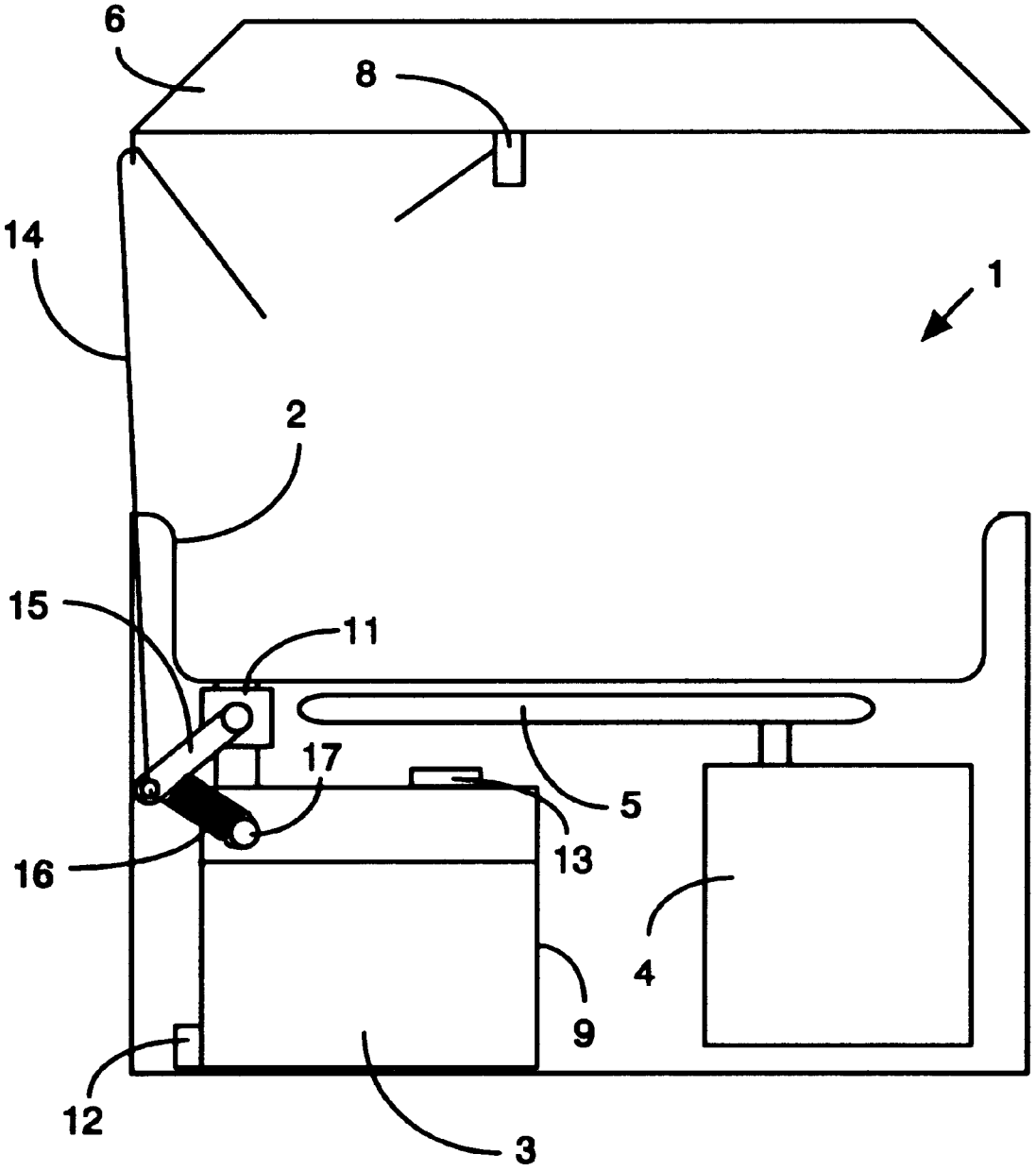
FIG. 6 illustrates the embodiment of FIG. 5 after the fuse link has been opened, and a spring loaded drain conduit control valve is in the open position.

In FIG. 6, the preferred embodiment of FIG. 5 is shown after the fuse link 14 has been opened due to a fire. The fuse link 14 releases the tension on lever 5 which is then pulled by spring 16. When lever 15 is moved by spring 16, the drain conduit control valve 11 is moved to the open position and the oil 3 drains into the oil storage tank 9.

Those skilled in the art will recognize that the mechanical activation of the drain conduit control valve 11, as illustrated in FIGS. 5 and 6 can be implemented in a variety of manners. In addition, the heating unit 4 is preferably gang switched with the lever 15 such that it is automatically turned off when lever 15 is activated and the deep fryer reservoir 2 is drained.

In addition to mechanical activation of the drain conduit control valve 11, and electronic activation circuit can alternatively be used. For example, an electronic temperature sensor can be used to detect a fire and to signal an electronically controlled solenoid which in turn controls activation of the drain conduit control valve 11. This is illustrated below in regard to FIG. 7.

Figure 7:
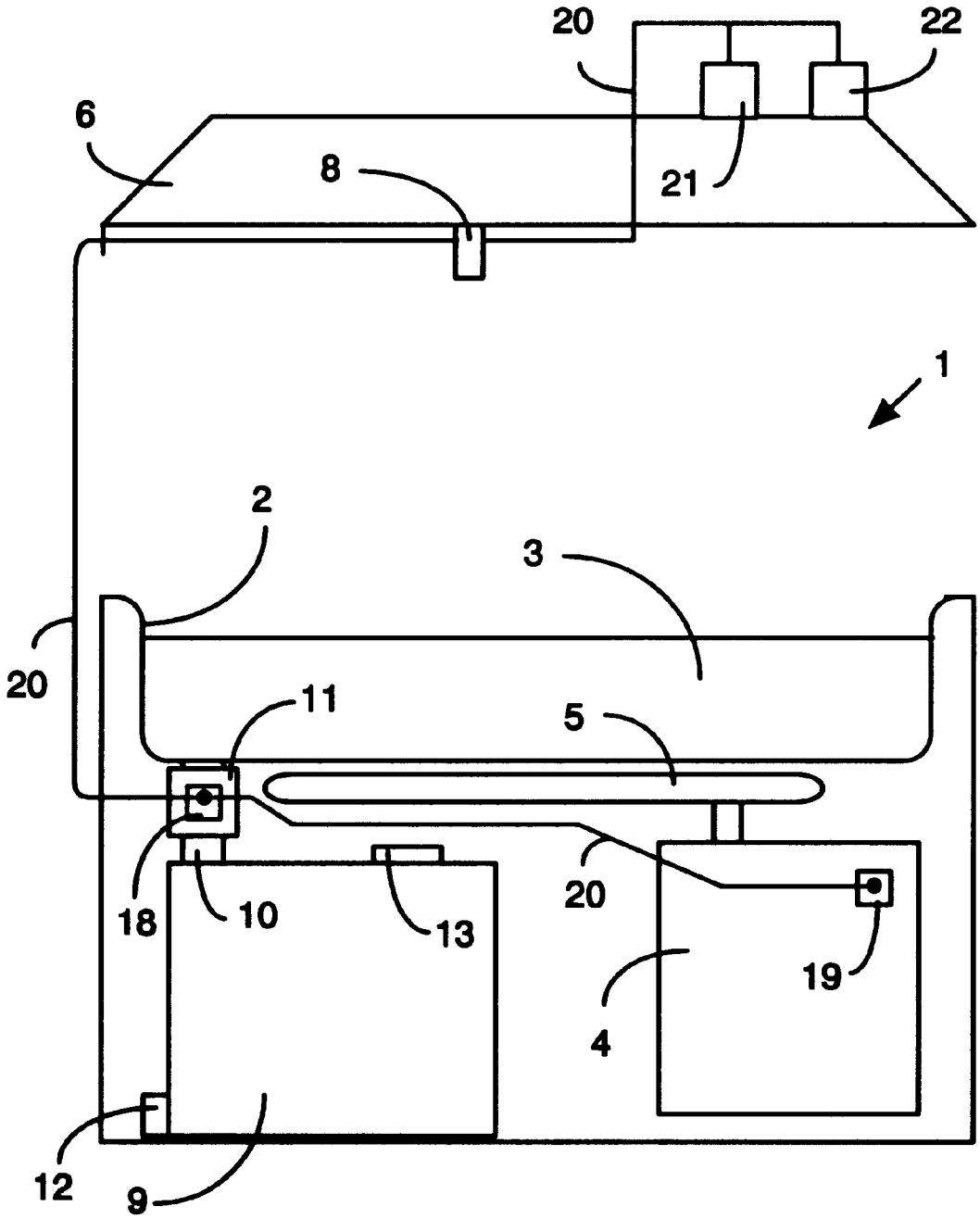
FIG. 7 illustrates an alternative preferred embodiment in which an electronically controlled solenoid is used to control the drain conduit control valve.

FIG. 7 illustrates an alternative preferred embodiment in which the drain conduit control valve 11 is electronically triggered. In this embodiment, fire detector 8 is an electronic device which generates an activation signal when fire is detected. Electronic and/or mechanical fire detectors are well known in the art. The activation signal is transmitted on line 20 and is received by the electronically controlled solenoid 18. Electronically controlled solenoids are well known in the art. The electronically controlled solenoid 18 opens the drain conduit control valve 11. When drain conduit control valve 11 opens, the oil 3 is drained from the deep fryer reservoir 2 into oil storage tank 9.

In the preferred embodiment, line 20 is also attached to electronic controls 19 of the heating unit 4. As a result, when the oil 3 in the deep fryer reservoir 2 is drained into the oil storage tank 9, the heating unit 4 is automatically turned off.

Those skilled in the art will recognize that while line 20 is shown is a hard wired connection, a wireless connection (for example, an RF link) can easily be substituted.

Also shown in this figure are optional audible alarm 21 and visual alarm 22. Both of these alarms may be triggered under control of the fire detector 8. For use of illustration, line 20 is used to provide a signal to the alarms. However, an independent signal line could easily be substituted.

As a result of the automatic removal of the oil 3 from the deep fryer reservoir 2, and its storage in a sealed oil storage tank 9, the fuel supply which would otherwise maintain and feed the fire in the deep fryer 1 is removed and the fire is quickly starved. The rapid extinguishing of the fire by elimination of its fuel supply greatly reduces the possibility that the fire may spread beyond the deep fryer 1, and greatly reduces possibility of injury to kitchen workers and emergency personnel.

It is also possible to use this invention in combination with conventional hood mounted fire extinguishing systems. When this combination approach is used, fire may be extinguished even faster. However, the chemicals used by the hood mounted fire extinguishing system may render the oil 3 unsuitable for reuse. Alternatively, the twostep approach may be used wherein first the oil 3 is drained into the storage tank 9, and then, if the temperature does not decrease, the hood mounted fire extinguishing system may be activated. To implement this approach, the fire detector 8 should have a timer circuit (not shown) to allow the fire detector 8 to measure temperature change over a predetermined period of time. If the temperature from the fire in the oil reservoir 2 has not decreased after the oil has been drained, the fire extinguisher 7 would then be activated.

While the invention has been described with respect to a preferred embodiment thereof, it will be understood by those skilled in the art that various changes in detail may be made therein without departing from the spirit, scope, and teaching of the invention. For example, the type of fire sensing device may be anything suitable for the task, the type of valve controls can vary, etc. Accordingly, the invention herein disclosed is to be limited only as specified in the following claims.

I claim:

1. A deep fryer with an automatic oil drainage system, further comprising: an oil reservoir for holding oil:

a heating unit having a heating element for heating the oil reservoir;

an oil storage tank;

a drain conduit connecting the oil reservoir with the oil storage tank;

a drain conduit control valve attached to the drain conduit, the drain conduit control valve having an open position to allow oil flow through the drain conduit from the oil reservoir to the oil storage tank, and a closed position to prevent oil from flowing through the drain conduit from the oil reservoir to the oil storage tank;

a fire detector operatively connected to the drain conduit control valve such that when a fire is detected, the drain conduit control valve is moved from the closed position to the open position;

whereby oil in the oil reservoir is automatically moved to the storage tank when a fire is detected.

2. A deep fryer, as claim 1, further comprising:

a lever attached to the drain conduit control valve such that movement of the lever controls movement of the drain conduit control valve;

the fuse link attached to the lever and providing tension on the lever to hold the drain conduit control valve in a closed position;

a spring attached to the lever and providing tension pulling the lever such that without the tension of the fuse link, the drain conduit control valve would move to the open position;

the fuse link further extending above the oil reservoir such that a fire in the oil reservoir will cause the fuse link to melt;

whereby a fire in the oil reservoir will melt the fuse link and automatically open the drain conduit control valve to drain the oil from the reservoir to the storage tank.

3. A deep fryer, as in claim 2, further comprising:

a heater control attached to the heater, the heater control having an on position in which the heating unit is active and an off position in which the heater is deactivated;

means to change the heater control to the off position when the fire detector detects the fire;

whereby when a fire is detected, the oil is automatically drained from the oil reservoir and the heating unit is automatically turned off.

4. A deep fryer, as in claim 2, further comprising:

an alarm controlled by the fire detector, the alarm having means to generate audible and/or visual alarm signals.

5. A deep fryer, as in claim 2, further comprising:

a fire extinguisher mounted above the oil reservoir and controlled by the fire detector;

the fire extinguisher activated by the fire detector when the fire detector detects a fire in the oil reservoir;

whereby when a fire is detected, the oil is drained from the oil reservoir and the fire extinguisher is activated.

6. A deep fryer, as in claim 5, wherein:

the fire extinguisher is activated simultaneously with activation of the drain conduit control valve.

7. A deep fryer, as in claim 5, further comprising:

means in the fire detector to monitor temperatures in the oil reservoir after a fire has been detected and to activate the fire extinguisher if the temperature in the oil reservoir does not decrease after a predetermined time interval.

8. A deep fryer, as claim 1, further comprising:

a solenoid attached to the drain conduit control valve such that the solenoid controls the drain conduit control valve;

the fire detector operatively connected to the solenoid such that when the fire detector detects the fire, it activates the solenoid which opens the drain conduit control valve and drains the oil of the reservoir into the storage tank.

9. A deep fryer, as in claim 8, filthier comprising:

a heater control attached to the heater, the heater control having an on position in which the heating unit is active and an off position in which the heater is deactivated;

means to change the heater control to the off position when the fire detector detects the fire;

whereby when a fire is detected, the oil is automatically drained from the oil reservoir and the heating unit is automatically turned off.

10. A deep fryer, as in claim 9, furtherer comprising:

an alarm controlled by the fire detector, the alarm having means to generate audible and/or visual alarm signals.

11. A deep fryer, as in claim 9, further comprising:

a fire extinguisher mounted above the oil reservoir and controlled by the fire detector;

the fire extinguisher activated by the fire detector when the fire detector detects a fire in the oil reservoir;

whereby when a fire is detected, the oil is drained from the oil reservoir and the fire extinguisher is activated.

12. A deep fryer, as in claim 11, wherein:

the fire extinguisher is activated simultaneously with activation of the drain conduit control valve.

13. A deep fryer, as in claim 11, further comprising:

means in the fire detector to monitor temperatures in the oil reservoir after a fire has been detected and to activate the fire extinguisher if the temperature in the oil reservoir does not decrease after a predetermined time interval.

14. A method of extinguishing fires in a deep fryer with an automatic oil drainage system, further comprising:

using an oil reservoir to hold oil:

heating the oil reservoir with a heating unit having a heating element;

connecting an oil storage tank to the oil reservoir with a drain conduit;

controlling the transfer of oil via the drain conduit between the oil reservoir and the storage tank with a drain conduit control valve, the drain conduit control valve having an open position to allow oil flow through the drain conduit from the oil reservoir to the oil storage tank, and a closed position to prevent oil from flowing through the drain conduit from the oil reservoir to the oil storage tank;

using a fire detector to detect a fire in the oil reservoir and activating the drain conduit control valve when a fire is detected such that the drain conduit control valve is moved from the closed position to the open position;

whereby oil in the oil reservoir is automatically moved to the storage tank when a fire is detected.

15. A method, as in claim 14, including the additional steps of:

controlling the heating unit with a heater control such that the heating unit has an on position in which the heating unit is active and an off position in which the heating unit is deactivated;

moving the heater control to the off position when the fire detector detects the fire;

whereby when a fire is detected, the oil is automatically drained from the oil reservoir and the heating unit is automatically turned off.

16. A method, as in claim 14, including the additional steps of:

an alarm controlled by the fire detector, the alarm having means to generate audible and/or visual alarm signals.

17. A method, as claim 14, including the additional steps of:

attaching a lever to the drain conduit control valve such that movement of the lever controls movement of the drain conduit control valve;

providing tension on the lever with a fuse link that is attached to the lever such that it holds the drain conduit control valve in the closed position;

attaching a spring to the lever and providing tension on the lever such that without the tension of the fuse link, the drain conduit control valve would move to the open position;

extending the fuse link above the oil reservoir such that a fire in the oil reservoir will cause the fuse link to melt;

whereby a fire in the oil reservoir will melt the fuse link and automatically open the drain conduit control valve to drain the oil from the reservoir to the storage tank.

18. A method, as in claim 17, including the additional steps of:

controlling the heating unit with a heater control such that the heating unit has an on position in which the heating unit is active and an off position in which the heating unit is deactivated;

moving the heater control to the off position when the fire detector detects the fire;

whereby when a fire is detected, the oil is automatically drained from the oil reservoir and the heating unit is automatically turned off.

19. A method, as in claim 18, including the additional steps of:

controlling the drain conduit control valve with a solenoid;

controlling the solenoid with the fire detector such that when the fire detector detects the fire, it activates the solenoid which opens the drain conduit control valve and drains the oil out of the reservoir into the storage tank.

20. A method, as in claim 19, including the additional steps of:

controlling the heating unit with a heater control such that the heating unit has an on position in which the heating unit is active and an off position in which the heating unit is deactivated;

moving the heater control to the off position when the fire detector detects the fire;

whereby when a fire is detected, the oil is automatically drained from the oil reservoir and the heating unit is automatically tuned off.

* * * * *